US005233863A

United States Patent [19]

Surjaatmadja et al.

[11] Patent Number: 5,233,863

[45] Date of Patent: Aug. 10, 1993

[54] FLUID LOSS MEASURING SYSTEM AND METHOD

[75] Inventors: Jim B. Surjaatmadja; Mark L. Suttle; Keith E. Blaschke; Stewart E. Rowell, all of Duncan, Okla.

[73] Assignee: Halliburton Company, Duncan, Okla.

[21] Appl. No.: 860,490

[22] Filed: Mar. 30, 1992

[51] Int. Cl.[5] ..... G01N 15/04; G01N 33/26

[52] U.S. Cl. ..... 73/61.64; 73/239

[58] Field of Search ..... 73/61.43, 61.63, 61.64, 73/232, 239; 364/510, 579

[56] References Cited

U.S. PATENT DOCUMENTS

| | | | |
|---|---|---|---|
| 3,055,208 | 9/1962 | Gallus | 73/53 |
| 3,286,510 | 11/1966 | Parker | 73/53 |
| 3,289,467 | 12/1966 | Parker et al. | 73/61.4 |
| 3,438,246 | 4/1969 | Lotti | 73/40 |
| 3,442,135 | 5/1969 | Liu | 73/419 |
| 3,525,263 | 8/1970 | Rupert | 73/419 |
| 3,768,510 | 10/1973 | Reves | 73/239 |
| 4,052,892 | 10/1977 | Browne | 73/239 |
| 4,243,856 | 1/1981 | Gratzmuller | 200/81.5 |
| 4,297,687 | 10/1981 | Fuzzell | 340/626 |
| 4,430,889 | 2/1984 | Sutton | 73/61.4 |
| 4,446,726 | 5/1984 | Hockenberry | 73/61.64 |
| 4,463,603 | 8/1984 | Welker | 73/239 |
| 4,538,452 | 9/1985 | Hrvojic | 73/61.64 |
| 4,575,807 | 3/1986 | Dodge | 364/510 |
| 4,602,250 | 7/1986 | Peace | 340/605 |
| 4,748,849 | 6/1988 | Jamison et al. | 73/61.64 |
| 4,827,430 | 5/1989 | Aid et al. | 364/510 |
| 4,917,349 | 4/1990 | Surjaatmadja et al. | 251/63 |

*Primary Examiner*—Hezron E. Williams
*Assistant Examiner*—Michael Brock
*Attorney, Agent, or Firm*—James R. Duzan; E. Harrison Gilbert, III

[57] ABSTRACT

A fluid loss cell has an outlet through which fluid lost during a fluid loss test flows. This outlet is connected in closed pressure communication with a fluid measuring device that senses the amount of lost fluid received in the device and generates an electrical signal representative of the sensed amount. The signal is preferably provided to a computer so that automatic monitoring of the fluid loss occurs. The fluid measuring device contains blow off pressure and subsequent increased fluid amounts. Valves and pressure regulators are included in a preferred embodiment. A related method is disclosed.

16 Claims, 2 Drawing Sheets

FLUID LOSS MEASURING SYSTEM AND METHOD

BACKGROUND OF THE INVENTION

This invention relates generally to a fluid loss measuring system and method and particularly, but not by way of limitation, to such a system and method in which the amount of fluid loss is automatically sensed and indicated to a computer.

In the oil and gas industry, different types of fluids can be pumped into a well for various purposes. For example, a cement slurry can be pumped in a well to secure tubular casing for supporting the well bore, and a fracturing fluid can be pumped through a well into a geological formation to open it for improving flow of oil or gas into the well. Because these fluids typically come into contact with one or more porous subterranean formations, at least part of such fluids can leak off into the formations. Such fluid loss can be expensive, both because more fluid has to be put downhole to achieve the desired function for which the lost fluid is unavailable and because the lost fluid can damage the formation such that it is rendered less productive. Furthermore, such fluid loss can adversely affect the nature of the fluid as different constituents of the fluid can leak off in varying amounts such that the relative concentrations within the remaining fluid are different from the designed and originally pumped in fluid.

To try to overcome the fluid loss problem, fluid loss tests can be run to determine how much loss is likely to occur and whether one type of fluid is less susceptible to leak off than another. In one type of fluid loss test, a core sample from a formation is placed in a fluid loss cell having an inlet and an outlet. The fluid to be tested is introduced, such as by being pumped, into the fluid loss cell. Typically this occurs under pressure, such as can be imparted by steam or nitrogen, for example. The fluid can be held in the cell or flow through it.

The fluid contacts the core sample, which acts as a filter due to its inherent porosity, and any fluid loss through the sample is retrieved through the outlet of the fluid loss cell. The collected fluid is typically manually measured, such as in a graduated cylinder disposed below the outlet of the cell.

A phenomenon of such a test is known as "blow off." This occurs when the core sample (or other type of filter) becomes depleted whereupon exiting gases cause rapid increase in pressure. The timing of this typically cannot be predetermined so that a safety problem can occur due to the rapid pressure output occurring at an unknown time. Blow off also changes the rate of fluid loss so that if the entire test is not carefully monitored, incremental quantities and rates of fluid loss will not be known since they are not constant.

Another aspect of fluid loss testing in the oil and gas industry is that it is becoming more and more automated with the advent of microprocessor-based computers. The aforementioned manual technique of taking fluid loss readings does not provide input directly into any such computer.

To overcome the foregoing shortcomings of the aforementioned fluid loss testing of which we are aware, there is the need for a fluid loss measuring system and method in which the fluid from the fluid loss occurring through a selected filter in a fluid loss cell is automatically sensed and indicated, preferably in a manner adapted for direct input and use by a computer that may be controlling aspects of the fluid loss test. Such a system and method should be able to contain and respond to a blow off condition.

SUMMARY OF THE INVENTION

The present invention overcomes the above-noted and other shortcomings of the prior art by providing a novel and improved fluid loss measuring system and method. The present invention provides automatic monitoring of fluid lost through a filter member in a fluid loss cell. It safely contains blow off pressure, and it provides output from which continuous fluid loss information can be obtained so that the blow off point and the different quantities and rates of fluid loss can be readily determined. The present invention preferably includes, or is adapted for use with, a computer that can control other aspects of the fluid loss test. For example, in a preferred embodiment the computer can control valves and pressure regulators to adjust flow and pressure in the system.

The present invention provides a fluid loss measuring system, comprising: a fluid loss cell having defined therein a chamber and an inlet into the chamber and an outlet from the chamber, which chamber is adapted to receive a filter member through which fluid loss can occur from a fluid introduced into the chamber through the inlet under pressure; and means, connected in a closed pressure circuit to the outlet of the fluid loss cell, for receiving fluid from fluid loss that occurs and for generating an electrical signal, adapted for use by a computer, representative of the volume of fluid received.

The system of the preferred embodiment contains the blow off within the means for receiving the fluid and for generating the electrical signal. Such means of the preferred embodiment includes: a pressure responsive member having a predetermined limit of travel; and damping means for slowing the rate of travel of the pressure responsive member as it approaches the limit of travel. The preferred embodiment also includes two valves and pressure regulators controlled by a computer also preferably in the system.

The present invention also provides a method of measuring fluid loss through a filter disposed in a fluid loss cell having an inlet for receiving a pressurized fluid and having an outlet for outputting fluid of the fluid loss, which method comprises: moving a piston in a housing connected through a port in closed pressure communication with the outlet of the fluid loss cell so that displacement of the piston in the housing is proportional to the volume of the output fluid of the fluid loss; generating an electrical signal in response to the position of the piston in the housing; and communicating the electrical signal to a computer for specifying the amount of fluid of the fluid loss output from the fluid loss cell.

The method preferably further comprises applying a back pressure against the piston through a second port defined in the housing. The method also preferably further comprises containing blow off fluid loss pressure within the housing and detecting when it has occurred.

Therefore, from the foregoing, it is a general object of the present invention to provide a novel and improved fluid loss measuring system and method. Other and further objects, features and advantages of the present invention will be readily apparent to those skilled in the art when the following description of the preferred embodiment is read in conjunction with the accompanying drawings.

DETAILED DESCRIPTION OF PREFERRED EMBODIMENT

Figure 1:
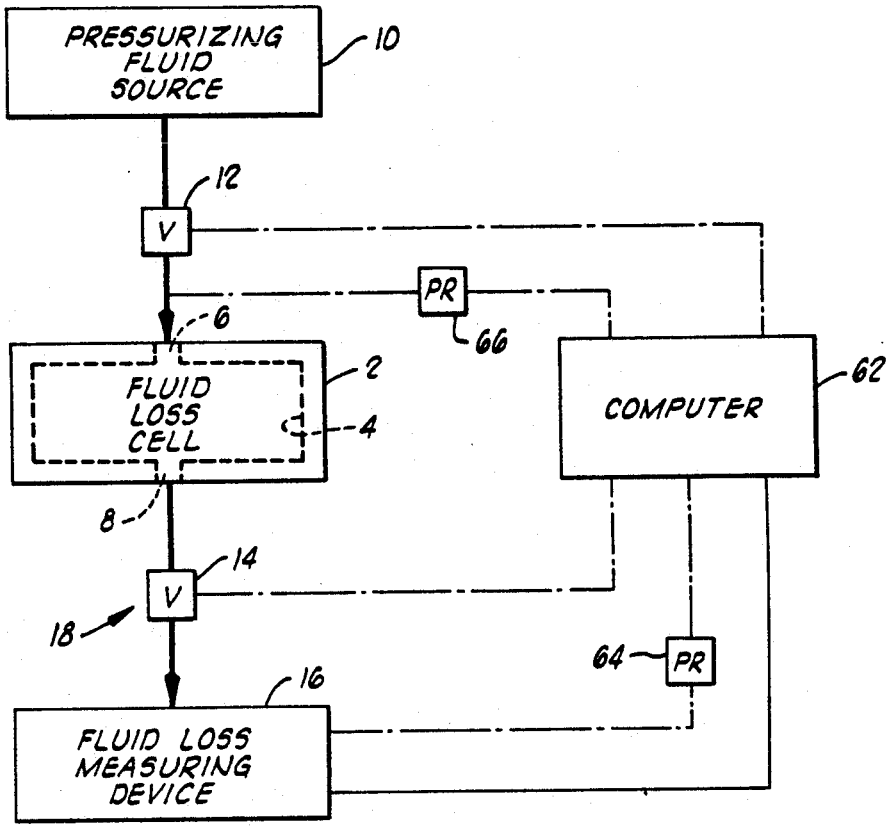
FIG. 1 is a block diagram of the fluid loss measuring system of the present invention.

The preferred embodiment fluid loss measuring system of the present invention is depicted in FIG. 1. It includes a conventional fluid loss cell 2, such as one shown in U.S. Pat. No. 4,430,889 to Sutton, incorporated herein by reference. Such a fluid loss cell has an interior chamber 4 with at least an inlet 6 and an outlet 8. The chamber 4 is adapted to receive a filter member of a desired type as known in the art. An example of a filter member is a cylindrical core sample representative of a geological formation into which the fluid to be tested is intended to be pumped. The fluid loss cell 2 can have various equipment associated with it, such as heating strips, as known in the art.

To introduce the test fluid into the fluid loss cell 2, the system includes a pressurizing fluid source 10 connected to the inlet 6 of the fluid loss cell 2 through a valve 12. The source 10 can include, for example, a reservoir of the fluid and a pump for pumping the fluid into the fluid loss cell 2. Other ways of introducing and pressurizing the fluid can be used. For example, steam or pressurized nitrogen can be used to pressurize the fluid loss cell 2.

The fluid in the fluid loss cell 2 can be static or it can be circulated. Such circulation would occur through another outlet (not shown), not the outlet 8. The outlet 8 is used to drain fluid which has been lost from the main body of fluid in the chamber 4 via leakage or permeation through the structure of the filter member as known in the art. Such lost fluid passes through a valve 14 (when the valve is open) into a fluid loss measuring device 16 of the present invention.

The circuit connecting the outlet 8 to the fluid loss measuring device 16, which circuit includes the valve 14, is a closed circuit in that it contains the above-ambient pressure which exists at this location in the fluid loss measuring system. That is, this circuit (identified in FIG. 1 by the reference numeral 18) includes one or more fluid conductors or conduits which contain the fluid transfer from the outlet 8 to the fluid loss measuring device 16 and isolate it from the surrounding environment. In this way the circuit 18 and the fluid loss measuring device 16 contain a blow off fluid loss event (i.e., sudden high pressure and fluid flow out of the outlet 8).

Figure 2:
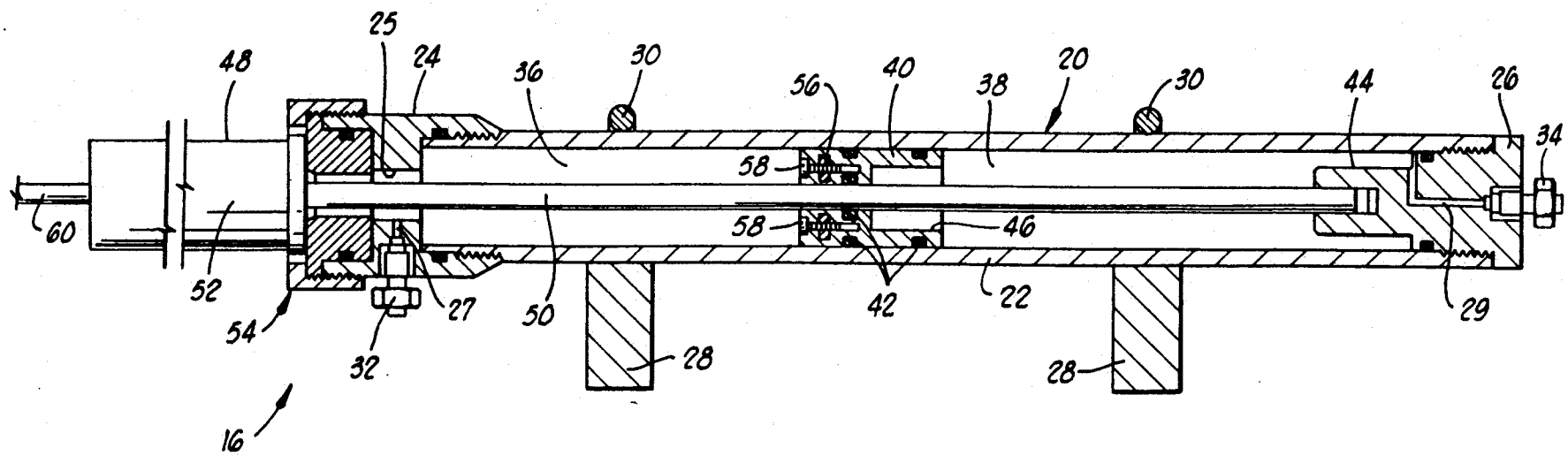
FIG. 2 is a sectional view of a fluid measuring device of the system of the present invention.

The fluid loss measuring device 16 receives fluid from fluid loss that occurs in the fluid loss cell 2, and it generates an electrical signal representative of the volume of fluid received. Preferably, the electrical signal is adapted in a known manner for use by a computer as further explained hereinbelow. The preferred embodiment of the fluid loss measuring device 16 will next be described with reference to FIG. 2.

The fluid loss measuring device 16 includes a housing 20 that contains the fluid loss volume and the pressure communicated through the closed circuit 18. The housing 20 is defined by a cylindrical tube 22 and threadedly connected, seal carrying end caps 24, 26 made of a suitable material (e.g., stainless steel). The tube 22 is shown retained on two blocks 28 by U-bolts 30. The end cap 24 has an axial opening 25 and a port receiving a coupling 32 for connecting in the circuit 18, and the end cap 26 has a port receiving a coupling 34 for a purpose subsequently described. The ports of the end caps 24, 26 communicate, through respective channels 27, 29 defined in their respective end caps, with respective variable volumes 36, 38 within the tube 22.

Variable volumes 36, 38 are defined within the tube 22 on opposite sides of a piston 40 which is slidably disposed within the tube 22 so that the piston 40 moves in response to pressure acting on it from within the volumes 36, 38. As the piston 40 moves, the sizes of the volumes 36, 38 varies. The piston 40 is cylindrical, and it carries sealing rings 42 on it to seal between the outer surface of the piston 40 and the inner surface of the tube 22 and between the inner surface of the piston 40 and the outer surface of a bar 50 on which the piston 40 is concentrically and slidably mounted, thereby isolating the two volumes 36, 38 from each other at their common boundary defined by the piston 40 and the seals 42. This allows a pressure differential to be created or exist across the piston 40 and between the ports receiving the couplings 32, 34.

The piston 40 has a predetermined limit of travel within the tube 22 as defined by the distance between the innermost ends of the end caps 24, 26 against which the piston 40 abuts at the limits of its travel. To slow the speed of the piston 40 as it approaches the limit of travel toward the end cap 26, the device 16 includes damping means defined by a neck 44 of the end cap 26 and a throat 46 of the piston 40. These two elements (specifically, their surfaces) frictionally engage to slow the piston 40. This prevents or reduces "banging" of the housing 20 by the piston 40 during blow off. This damping means is provided only at this end of the device 16 because this is the only direction of movement of the piston 40 in response to the fluid loss event to be monitored. Although the piston 40 can move toward the end cap 24, this is typically a controlled movement made in response to control pressure applied through the port 34.

The fluid loss measuring device 16 also includes means for generating the aforementioned electrical signal in response to a position the piston 40 is moved within the housing 20 in response to fluid received through the port 32 due to fluid loss in the fluid loss cell 2. In the FIG. 2 embodiment, this signal generating means is implemented by a magnetostrictive sensor 48, such as a Balluff model BTL-E26-0305-Z-S32. The sensor 48 shown in FIG. 2 includes the stationary bar 50 extending axially through the housing 20. One end is supported in the neck 44 of the end cap 26, and the other end is connected into electrical circuits within a body 52 of the sensor 48. The body 52 is attached to the housing 20 by a retaining ring and sealing member assembly 54. The sensor 48 responds to the position of the piston 40 by the interaction between the bar 50 and an annular magnet 56, which is movable relative to the bar 50 since the magnet is secured to the piston 40 by screws 58. The generated electrical signal indicating the relationship between the magnet 56 and the bar 50 is conducted through a cable 60 extending from the body 52.

Referring to FIG. 1, the cable 60 is preferably connected to a computer 62. The computer 62 is programmed to receive the signal transmitted over the cable 60 and to determine from that signal how much fluid has been received in the housing 20 due to fluid loss out of the fluid loss cell 2. Such programming can be readily implemented by those skilled in the art given the operating characteristics of a particular sensor 48 and the dimensions of a particular housing 20 by which the linear displacement of the piston 40 in the housing 20 (given by the signal from the sensor 48) can be converted into a measure of the volume 36 having its size defined in response to the fluid received therein from the fluid loss cell 2.

The computer 62 can be any suitable type, but it is contemplated as preferably a microprocessor-based computer. It is specifically contemplated that it can be one by which other control functions are implemented to control the fluid loss test. For example, the computer 62 can control the valves 12, 14, and it can control pressure regulators 64, 66 which can be incorporated into the fluid loss measuring system. In the preferred embodiment, the pressure regulator 64 is connected to the end cap 26 port via the coupling 34, and the pressure regulator 66 is connected to the inlet 6 of the fluid loss cell 2. The pressure regulator 64 can be used, for example, to apply a back pressure on the piston 40 through the port 34 such as when high temperatures are being used in the fluid loss cell 2. Such a back pressure can be greater than the pressure applied in the fluid loss cell 2 via the pressurizing fluid source 10. A desired pressure differential between these two pressures can be adjusted using the pressure regulator 66, for example. Control of the valves 12, 14 and the pressure regulators 64, 66 will be readily apparent to those skilled in the art.

The valves 12, 14 and the pressure regulators 64, 66 are of conventional types known in the art. For example, the valves 12, 14 can be high pressure air controlled valves that can be controlled by the computer 62 (or manually if desired) in conducting the fluid loss test. A specific example is the valve used by Surjaatmadja et al. in U.S. Pat. No. 4,917,349, incorporated herein by reference.

To use the system of the present invention, the fluid loss cell 2 is loaded with a selected filter member and a selected test fluid in known manner. In general, the valves 12, 14, and the pressure regulators 64, 66 if used, are controlled manually or by the computer 62 to introduce the test fluid into the fluid loss cell 2 and to pressurize it. To monitor for fluid loss, the valve 14 is opened.

As fluid from inside the fluid loss cell 2 is lost through the filter member, it flows into the fluid loss measuring device 16 through the closed pressure circuit 18 connected to the outlet 8 of the fluid loss cell 2. As this lost fluid accumulates in the volume 36 of the device 16, it moves the piston 40 in proportion to the volume of the accumulated fluid. The position of the piston 40 relative to the bar 50 is detected by the sensor 48, which generates an electrical signal in response. The electrical signal is communicated to the computer 62 over the cable 60 so that the computer 62 thereby has data from which to calculate the volume of fluid lost through the filter member in the fluid loss cell 2. The foregoing is continued over time so that several electrical signals are provided to the computer 62. From the information provided by the electrical signals, an increasing volume 36, and thus an increasing quantity of fluid received in and defining the volume 36 due to fluid loss over time, can be monitored. This provides several data points that can be analyzed. See FIG. 3.

Figure 3:
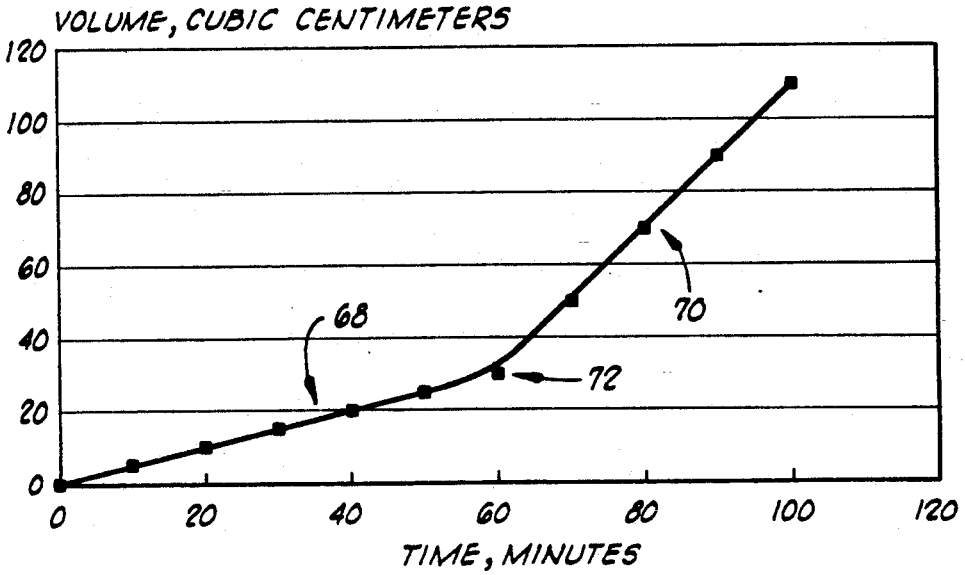
FIG. 3 is a graph showing detected fluid loss over time and the change therein due to blow off.

Referring to FIG. 3, one will see two substantially linear regions 68, 70 of a curve fit to the data points. A knee or break point region 72 between the linear region 68 of slower volumetric changes and the linear region 70 of faster volumetric changes indicates where blow off has occurred. Thus, the present invention is able to contain and respond to the pressure and fluid changes occurring before, through and after blow off. The initial response of the system is made via movement of the piston 40, which movement is sensed by the sensor 48. As the piston 40 nears its limit of travel to the right as viewed in FIG. 2, its movement is damped by the interaction of the neck 44 and throat 46 referred to above.

If it is desired to apply a back pressure against the piston 40, such as for insuring that the system pressure is greater than saturation pressure of the liquid at the test temperature, this can be done using the pressure regulator 64 connected to the coupling 34 as explained above. The pressure differential across the piston 40 can then be adjusted using the pressure regulator 66 also as referred to above.

Thus, the present invention is well adapted to carry out the objects and attain the ends and advantages mentioned above as well as those inherent therein. While a preferred embodiment of the invention has been described for the purpose of this disclosure, changes in the construction and arrangement of parts and the performance of steps can be made by those skilled in the art, which changes are encompassed within the spirit of this invention as defined by the appended claims.

What is claimed is:

1. A fluid loss measuring system, comprising:

a fluid loss cell having defined therein a chamber and an inlet into said chamber and an outlet from said chamber, said chamber adapted to receive a filter member through which fluid loss can occur from a fluid introduced into said chamber through said inlet under pressure; and means, connected in a closed pressure circuit to said outlet of said fluid loss cell, for receiving fluid from fluid loss that occurs and for generating an electrical signal, adapted for use by a computer, representative of the volume of fluid received, wherein said means contains and responds to a blow off fluid loss from said fluid loss cell, said means including:

a pressure response member having a predetermined limit of travel; and structural damping means for frictionally engaging said pressure responsive member for slowing the rate of travel of said pressure responsive member as it approaches said limit of travel in response to a blow off fluid loss from said fluid loss cell.

2. A fluid loss measuring system as defined in claim 1, further comprising:

a first pressure regulator, connected to said inlet of said fluid loss cell; and a second pressure regulator, connected to said means.

3. A fluid loss measuring system as defined in claim 1, further comprising:

a pressurized fluid source;

a first valve, connected to said pressurized fluid source and said inlet of said fluid loss cell; and a second valve, connected in said closed pressure circuit to said outlet of said fluid loss cell and to said means.

4. A fluid loss measuring system, comprising:

a fluid loss cell having defined therein a chamber and an inlet into said chamber and an outlet from said chamber, said chamber adapted to receive a filter member through which fluid loss can occur from a fluid introduced into said chamber through said inlet under pressure; and a fluid metering device, including:

a housing having a first port and a second port defined therein, said first port connected in closed fluid communication solely with said outlet of said fluid loss cell so that fluid from fluid loss occurring in said fluid loss cell flows into said housing, said housing including a neck portion extending into an internal volume of said housing;

a piston slidably disposed in said housing between said first and second ports, said piston having a throat for frictionally engaging said neck portion of said housing to slow the rate of travel of said piston when said piston moves in response to a blow off condition in said fluid loss cell; and means for generating an electrical signal in response to a position to which said piston is moved within said housing in response to fluid received through said first port in response to fluid loss in said fluid loss cell.

5. A fluid loss measuring system as defined in claim 4, further comprising:

a first pressure regulator, connected to said inlet of said fluid loss cell; and a second pressure regulator, connected to said second port of said housing.

6. A fluid loss measuring system as defined in claim 5, further comprising a seal between said piston and said housing so that a pressure differential can exist across said piston between said first and second ports.

7. A fluid loss measuring system as defined in claim 6, further comprising:

a pressurized fluid source;

a first valve, connected to said pressurized fluid source and said inlet of said fluid loss cell; and a second valve, connected in said closed fluid communication between said outlet of said fluid loss cell and said first port of said housing.

8. A fluid loss measuring system as defined in claim 7, further comprising a computer connected to said means for generating, said first valve and said second valve.

9. A fluid loss measuring system as defined in claim 8, wherein said computer is connected to said first and second pressure regulators.

10. A fluid loss measuring system as defined in claim 4, further comprising:

a pressurized fluid source;

a first valve, connected to said pressurized fluid source and said inlet of said fluid loss cell; and a second valve, connected in said closed fluid communication between said outlet of said fluid loss cell and said first port of said housing.

11. A fluid loss measuring system as defined in claim 4, further comprising a computer connected to receive said electrical signal from said means for generating.

12. A fluid loss measuring system as defined in claim 4, wherein said means for generating includes a magnetostrictive sensor connected to said housing and having said piston mounted thereon.

13. A method of measuring fluid loss through a filter disposed in a fluid loss cell having an inlet for receiving a pressurized fluid and having an outlet for outputting fluid of the fluid loss, said method comprising:

moving a piston in a housing connected through a port in closed pressure communication with the outlet of the fluid loss cell so that displacement of the piston in the housing is proportional to the volume of the output fluid of the fluid loss;

containing blow off fluid loss pressure within the housing;

damping movement of the piston in response to containing blow off fluid loss pressure within the housing, including increasing frictional engagement between the piston and the housing as the piston nears a limit of its movement within the housing;

generating an electrical signal in response to the position of the piston in the housing; and communicating the electrical signal to a computer for specifying the amount of fluid of the fluid loss output from the fluid loss cell.

14. A method of measuring fluid loss as defined in claim 13, further comprising applying a back pressure against the piston through a second port defined in the housing.

15. A method of measuring fluid loss as defined in claim 13, further comprising:

performing the steps of moving, generating and communicating over time so that a plurality of electrical signals are provided to the computer from which to monitor an increasing volume of fluid due to fluid loss over time; and detecting from the monitored increasing volume of fluid when blow off has occurred.

16. A method of measuring fluid loss as defined in claim 15, further comprising applying a back pressure against the piston through a second port defined in the housing and adjusting a pressure regulator connected to the inlet of the fluid loss cell for defining a selected pressure differential across the piston.

* * * * *